US005630930A

United States Patent [19]

Maloney

[11] Patent Number: 5,630,930

[45] Date of Patent: May 20, 1997

[54] METHOD FOR STARTING A CHLOR-ALKALI DIAPHRAGM CELL

[75] Inventor: Bernard A. Maloney, Pittsburgh, Pa.

[73] Assignee: PPG Industries, Inc., Pittsburgh, Pa.

[21] Appl. No.: 507,173

[22] Filed: Jul. 26, 1995

[51] Int. Cl.[6] ..... C25B 1/46

[52] U.S. Cl. ..... 205/350; 205/517

[58] Field of Search ..... 205/350, 516, 205/517, 536, 524

[56] References Cited

U.S. PATENT DOCUMENTS

| | | | |
|---|---|---|---|
| 3,793,163 | 2/1974 | Dotson | 205/350 |
| 3,991,251 | 11/1976 | Foster et al. | 428/289 |
| 4,170,537 | 10/1979 | Simmons | 204/295 |
| 4,170,538 | 10/1979 | Simmons | 204/295 |
| 4,170,539 | 10/1979 | Simmons | 204/295 |
| 4,173,526 | 11/1979 | Fang | 204/296 |
| 4,184,939 | 1/1980 | Kadija | 204/252 |
| 4,207,163 | 6/1980 | Kadija | 204/253 |
| 4,210,515 | 7/1980 | Patil et al. | 204/266 |
| 4,216,072 | 8/1980 | Kadija | 204/252 |
| 4,253,935 | 3/1981 | Simmons | 204/295 |
| 4,278,524 | 7/1981 | Kadija | 204/252 |
| 4,416,757 | 11/1983 | Kadija | 204/252 |
| 4,606,805 | 8/1986 | Bon | 204/296 |
| 4,665,120 | 5/1987 | Hruska et al. | 524/452 |
| 4,666,573 | 5/1987 | DuBois et al. | 204/98 |
| 4,680,101 | 7/1987 | Darlington et al. | 204/295 |
| 4,720,334 | 1/1988 | DuBois et al. | 204/296 |
| 4,853,101 | 8/1989 | Hruska et al. | 204/296 |
| 5,188,712 | 2/1993 | Dilmore et al. | 204/98 |
| 5,192,401 | 3/1993 | DuBois et al. | 204/98 |

OTHER PUBLICATIONS

T. F. Florkiewicz et al, "Polyramix™ A Non-Asbestos Diaphragm Separator", presented at The Chlorine Institute's 31st Plant Managers Seminar, Mar. 9, 1988.

*Primary Examiner*—John Niebling
*Assistant Examiner*—Brendan Mee
*Attorney, Agent, or Firm*—Irwin M. Stein

[57] ABSTRACT

Describes adding an anolyte soluble amphoteric material, e.g., an aluminum compound, to the anolyte of a chlor-alkali diaphragm cell having a synthetic diaphragm during the start-up period of the cell to reduce the permeability of the diaphragm. Complementary inorganic porosity modifying materials, e.g., magnesium materials such as magnesium chloride, and clays are also added to the anolyte during the start-up period of the cell.

18 Claims, 1 Drawing Sheet

Analysis of Start-Up Catholyte

METHOD FOR STARTING A CHLOR-ALKALI DIAPHRAGM CELL

FIELD OF THE INVENTION

This invention relates to an improved method for starting chlor-alkali diaphragm cells, particularly chlor-alkali cells that use an asbestos-free synthetic diaphragm. More particularly, this invention relates to lowering the permeability of a chlor-alkali cell diaphragm during start-up.

BACKGROUND OF THE INVENTION

The electrolysis of alkali metal halide brines, such as sodium chloride and potassium chloride brines, in electrolytic diaphragm cells is a well known commercial process. The electrolysis of such brines produces halogen, hydrogen and aqueous alkali metal hydroxide solutions. In the case of sodium chloride brines, the halogen produced is chlorine and the alkali metal hydroxide is sodium hydroxide. The electrolytic cell typically comprises an anolyte compartment with an anode therein, a catholyte compartment with a cathode therein, and a liquid permeable diaphragm which divides the electrolytic cell into the anolyte and catholyte compartments. In the foregoing electrolytic process, a solution of the alkali metal halide salt, e.g., sodium chloride brine, is fed to the anolyte compartment of the cell, percolates through the liquid permeable diaphragm into the catholyte compartment and then exits from the cell. With the application of direct current to the cell, halogen, e.g., chlorine, is evolved at the anode, hydrogen is evolved at the cathode and alkali metal hydroxide (from the combination of sodium ions with hydroxyl ions) is formed in the catholyte compartment.

The diaphragm, which separates the anolyte compartment from the catholyte compartment, must be sufficiently porous to permit the hydrodynamic flow of brine through it, but must also inhibit back migration of hydroxyl ions from the catholyte compartment into the anolyte compartment. In addition, the diaphragm should inhibit the mixing of evolved hydrogen and chlorine gases, which could pose an explosive hazard, and possess low electrical resistance, i.e., have a low IR drop. Historically, asbestos has been the most common diaphragm material used in these so-called chlor-alkali electrolytic cells. Subsequently, asbestos in combination with various polymeric resins, particularly fluorocarbon resins (the so-called polymer-modified asbestos diaphragms),have been used as diaphragm materials. Polymer-modified asbestos diaphragms, their preparation and use, are described in U.S. Pat. Nos. 4,065,534, 4,070,257, 4,142,951 and 4,410,411, the disclosures of which are incorporated herein by reference.

More recently, due primarily to possible health hazards posed by air-borne asbestos fibers in other applications, attempts have been made to produce asbestos-free diaphragms for use in chlor-alkali electrolytic cells. Such diaphragms, which are often referred to as synthetic diaphragms, are typically made of non-asbestos fibrous polymeric materials that are resistant to the corrosive environment of the operating chlor-alkali cell. Such materials are typically prepared from perfluorinated polymeric materials, e.g., polytetrafluoroethylene (PTFE). Such diaphragms may also contain various other modifiers and additives, such as inorganic fillers, pore formers, wetting agents, ion-exchange resins and the like. Examples of U.S. patents describing synthetic diaphragms include U.S. Pat. Nos. 4,036,729, 4,126,536, 4,170,537, 4,170,538, 4,170,539, 4,210,515, 4,606,805, 4,680,101, 4,853,101 and 4,720,334. The coating of synthetic diaphragms with various inorganic materials is described in U.S. Pat. Nos. 5,188,712 and 5,192,401.

Chlor-alkali cell diaphragms made principally of asbestos or polymer-modified asbestos generally do not suffer from excessive permeability during start-up of such a cell. However, synthetic diaphragms, as prepared, are generally significantly more permeable at start-up than comparable asbestos diaphragms. This condition leads to low liquid levels in the anolyte compartment using normal brine feed rates. Such "low level" cells, as they are sometimes called, require excessive brine feed and extra operator attention and monitoring.

DESCRIPTION OF THE INVENTION

The object of the present invention is to avoid the condition of low liquid anolyte level caused by high diaphragm permeability at start-up of a chlor alkali diaphragm cell without the excessive use of permanent permeability control materials. The invention accomplishes this objective by adding temporary permeability control materials; namely, amphoteric materials. Amphoteric materials are temporary by virtue of the fact that they are soluble at the alkaline conditions encountered in a chlor-alkali cell diaphragm under steady-state operation.

The importance of diaphragm permeability is that it determines the pressure or liquid level required to cause the electrolyte to move through the diaphragm at a desired rate. Good operation of the cell depends upon the anolyte liquid level always being high enough, to cover the top of the diaphragm, and upon the anolyte liquid always having enough pressure to hold the diaphragm in place against the cathode. If these minimum requirements are not met, hydrogen gas can be expected to enter the anode compartment and mix with the chlorine gas produced therein, which may cause an explosive condition. The specific minimum level depends upon the cell design, the diaphragm properties and pressures in the gas collection systems. In chlor-alkali diaphragm cells, permeability is too high when the liquid level in the anode compartment is less than about 5 inches (12.7 cm) above the top of the diaphragm while supplying sodium chloride brine to the cell at a rate of 2 or more gram equivalents of sodium per Faraday of electricity.

It is desirable that freshly prepared synthetic diaphragms have a brine permeability similar to that of asbestos diaphragms. However, because of the larger size of the particles comprising the diaphragm, it has been difficult to produce a synthetic diaphragm having the uniform permeability of an asbestos diaphragm. Consequently, inorganic materials, such as clay powder, that provides particulates, and magnesium compounds, e.g., magnesium chloride, which forms particulates under the conditions existing within the diaphragm (Dopants), are added to the operating cell's anolyte compartment to regulate the diaphragm's permeability and make it more uniform. This practice allows determination of the minimum total amount of inorganic material added to the diaphragm so that the diaphragm's electrical resistance is also minimized.

Because of the delay between the addition of dopants to the anolyte compartment and the observed affect on diaphragm permeability, it is not unusual to find that too much Dopant material is added inadvertently. Use of larger than required amounts of Dopants, such as clays and magnesium compounds, during start-up to regulate the permeability of the diaphragm results in an increased loading of the diaphragm with inorganic particulates. This results in the diaphragm becoming too thick or dense, which causes higher cell voltages and decreased cell efficiency, and requires also additional operator attention to and monitoring of the cell.

Due to the delay in regulating the final permeability of the synthetic diaphragms until after start-up, the permeability at start-up is greater than desired. In order to control the condition of low anolyte liquid levels during start-up, the practice is to increase the flow rate of the brine feed up to several times, e.g., 2 to 5 times, or 2 to 3 times, the steady state brine flow rate. However, use of higher than conventional brine flow rates dilutes the concentration of alkali metal hydroxide, e.g., sodium hydroxide, in the catholyte.

Unfortunately, even with the aforementioned procedures, it often takes several hours, e.g., 3 to 4 hours, sometimes several days, before the chlor-alkali diaphragm cell reaches substantially steady state operating conditions. During this unstable period, close supervision and controlled doping of the cells is required, which results in higher costs to operate the cell, as compared to steady state operation.

STATEMENT OF THE INVENTION

It has now been discovered that the permeability of synthetic diaphragms used in chlor-alkali electrolyte cells, can be modified quickly during the start-up period of such cells by adding an effective amount of an amphoteric metal compound to the anolyte compartment of the cell.

BRIEF DESCRIPTION OF THE DRAWING

The present invention may be understood by reference to the following detailed description and FIG. 1, which is a graph of the concentration of elemental magnesium and aluminum, and sodium hydroxide in the catholyte liquor versus time of cell operation.

DETAILED DESCRIPTION OF THE INVENTION

Figure 1:
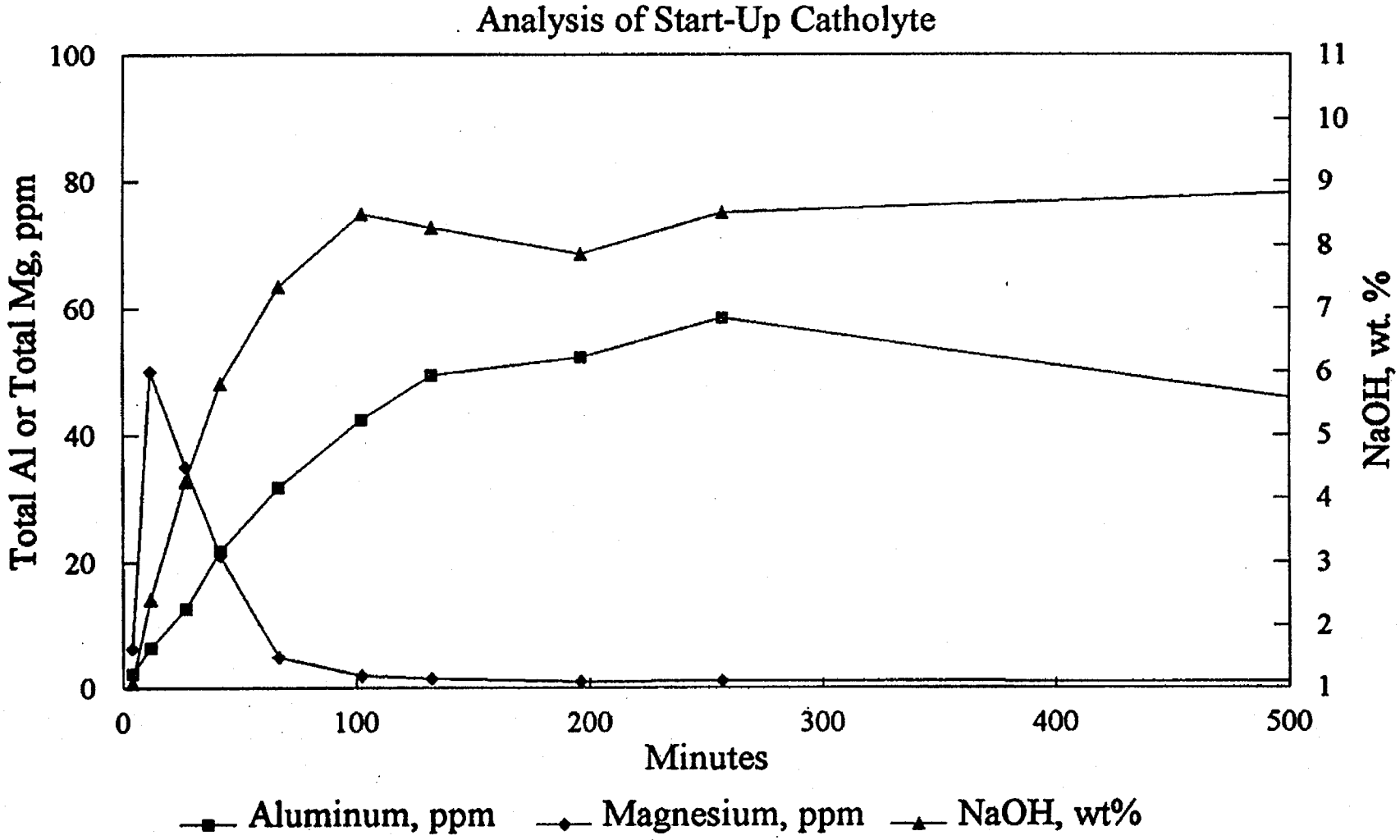

The present invention relates to a method for decreasing the permeability of a synthetic diaphragm used in chlor-alkali diaphragm electrolytic cells during start-up of such cells. More particularly, the present invention relates to the addition of an effective permeability moderating amount of an amphoteric compound to the anolyte compartment of a chlor-alkali electrolytic diaphragm cell during the start-up period, e.g., at start-up, of such cell, thereby to lower the permeability of the diaphragm to the passage of aqueous alkali metal halide brine through the diaphragm into the catholyte compartment.

As used in this description and the accompanying claims, all numbers or values expressing quantities of ingredients, reaction conditions, etc. (other than in the operating examples or where otherwise indicated) are to be understood as modified in all instances by the term "about".

As used herein and in the accompanying claims, the term "amphoteric compound" is intended to mean and include inorganic materials that (i) are substantially insoluble or form substantially insoluble materials under the conditions existing within the diaphragm during start-up of the cell, thereby to retain such materials within the diaphragm—resulting in the plugging of larger pores within the diaphragm, and (ii) that are dissolved within a few days, e.g., less than 7 days, by alkaline catholyte liquor after steady state operation of the cell is attained. The conditions within the diaphragm referred to include the pH and temperature of the catholyte liquor, the brine concentration, and the brine flow rate through the diaphragm.

While not wishing to be bound by any theory, it is believed that the following explains the results of using the amphoteric compound. At start-up, the pH of the catholyte liquor (which is usually brine at start-up) is low because of the absence of significant amounts of alkali metal hydroxide therein. Brine flow rate is high to maintain the anolyte liquid level above the height of the diaphragm. Consequently, the concentration of alkali metal hydroxide in the catholyte compartment during start-up is low because of dilution by the high rate of brine flow. An amphoteric compound of the present invention, which is soluble in the anolyte liquor (brine) is added to the anolyte compartment. As it is drawn through the diaphragm, it comes in contact with liquid within or on the surface of the diaphragm which has a pH, e.g., a pH on the order of about 5, that is sufficient to cause the amphoteric compound to form a gelatinous precipitate, which sticks to the fibers of the diaphragm and plugs some of the pores within the diaphragm. Compounds like magnesium chloride do not form a gelatinous precipitate at pH levels of about 5—requiring a pH of about 10 to form a precipitate that will adhere to the diaphragm fibers and not be washed away with the high rate of brine flow.) As the permeability of the diaphragm decreases, the brine flow rate is also decreased and the concentration of the product alkali metal hydroxide in the catholyte increases, which raises the pH of the product catholyte liquor in the catholyte and in the diaphragm. At a pH of about 10, the amphoteric compound precipitate is dissolved slowly and is washed out of the cell.

Examples of amphoteric materials that may be used in the process of the present invention include aluminum chloride, aluminum sulfate, aluminum nitrate and the hydrates of such aluminum compounds, such as aluminum chloride 6-hydrate, aluminum sulfate 12- and 18-hydrate and aluminum nitrate 9-hydrate; readily soluble forms of aluminum hydroxide, such as uncalcined, amorphous aluminum hydroxide gel; zinc chloride, zinc sulfate, zinc nitrate and the hydrates of such zinc compounds, such as zinc nitrate 3-hydrate, zinc nitrate 6-hydrate and zinc sulfate 6-hydrate, and readily soluble forms of zinc hydroxide, such as precipitated, uncalcined zinc hydroxide, and solutions of such amphoteric materials.

Excluded from amphoteric materials that may be used in the process of the present invention are materials such as aluminum silicate-containing clays, which are not readily soluble in the anolyte liquor during the start-up period, and are therefore incapable of providing a sufficient amount of particulate aluminum oxide or aluminum hydroxide (which deposit within or on the diaphragm) to moderate the diaphragm's permeability during that period. Also excluded are weakly amphoteric materials, such as iron hydroxide and zirconium hydrous oxides, which become only slightly more soluble with increasing alkalinity and would, therefore, not be dissolved by the catholyte liquor within a reasonable period of time, e.g., less than 1 weeks time, during steady-state operation.

The temperature of the anolyte and catholyte liquors during operation of the cell, including start-up conditions, will typically be n the range of from 150° to 210° F. (65.6°–98.9° C.). The concentration of the brine, e.g., aqueous sodium chloride solution, introduced into the anolyte compartment (and which forms the principle component of the anolyte) will typically be between 280 and 325 grams per liter (gpl), e.g., 305 to 320 gpl, alkali metal chloride, e.g., sodium chloride. In a typical chlor-alkali cell, the diaphragm should be able to pass from 0.02 to 0.1 cubic centimeters of anolyte per minute per square centimeter of diaphragm surface area. The flow rate is generally set at a rate that allows production of a predetermined, targeted alkali metal hydroxide concentration, e.g., sodium hydroxide concentration, in the catholyte. The level differential between the anolyte and catholyte compartments is then related to the porosity of the diaphragm and the size of the pores.

The pH of the anolyte at start-up will depend upon the pH of the brine feed. The brine may have a pH of from 10–11 due to brine treatments that eliminate undesirable impurities from the brine; however, the brine can be acidified after brine treatment to a pH of from 2–3 with, for example, hydrochloric acid, and the acidified brine introduced into the anolyte compartment during start-up. Even if brine having a pH of 10–11 is charged to the anolyte compartment, the pH of thus charged brine (anolyte liquor) will quickly drop to within the range of 2–3 on cell start-up because of the generation of hydrochloric and hypochlorous acids in the anolyte compartment from the hydrolysis of chlorine upon energizing the cell. The pH of the catholyte will depend on the concentration of the alkali metal hydroxide in the catholyte. During steady-state operation, the product catholyte liquor will have a concentration of from 9.5 to 11.5 weight percent alkali metal hydroxide, e.g., sodium hydroxide, which corresponds to a pH of a least 14.

The start-up period of the cell will typically be the period commencing when the cell is filled with brine and just prior to when direct current is applied to the cell and continuing for a period of 3 hours, more usually about 1 and ½ hours. However, when unusual difficulties are encountered during start-up, the start-up period may extend for a longer period of time, e.g., up to 48 hours. Stated differently, the start-up period typically will run from the time just prior to when direct current is applied to the cell until the concentration of product alkali metal hydroxide in the catholyte reaches 9.5–11.5 weight percent with a satisfactory anolyte level.

The amphoteric material may be added batch wise to the anolyte compartment at start-up mixed with or dissolved in brine, or as a solution in water. It is contemplated that the amphoteric material be added once at start-up, but if needed, additional amphoterial material can be added, as needed, subsequent to start-up and during the start-up period.

The amount of amphoteric material(s) added to the anolyte during start-up of the cell, is that amount which is sufficient to moderate, i.e., lower, the permeability of the diaphragm, thereby allowing substantially steady-state cell operating brine flow rates to the anolyte to be attained, the production of catholyte liquor containing from 9.5 to 11.5 weight percent alkali metal hydroxide, and an acceptable differential liquid level between the anolyte and catholyte compartments, which, as previously indicated, will vary with the design and type of electrolytic cell and the permeability of the diaphragm, i.e., a permeability moderating amount. The amount of amphoteric material added to the cell will vary with the amphoteric material used and the permeability of the cell. For aluminum, preferably from 15 to 35 grams per square meter of diaphragm surface of amphoteric aluminum material (expressed as elemental aluminum) may be added to the anolyte during start-up. Combinations of amphoteric materials may also be added to the anolyte during start-up.

Although the temporary effect of the amphoteric material on the permeability of the diaphragm allows wide latitude as to the amount and type of amphoteric material that may be used, it is to be understood that an inappropriate amount or type of amphoteric material could have detrimental effects or economic disadvantages due to alkali metal hydroxide product contamination or cost. Furthermore, although additives meeting the aforedescribed definition of "amphoteric" would be advantageous owing to their temporary effect, aluminum compounds are particularly desirable as being innocuous, inexpensive and effective. Considering these factors, a preferred embodiment of process of the present invention is the addition of aluminum chloride hydrate or aluminum sulfate in an amount equivalent to from 8 to 50 grams of aluminum (as elemental aluminum) per square meter of diaphragm surface. The addition of such compounds to the anolyte is preferably performed within 5 minutes of energizing the cell, i.e., applying direct current to the cell.

The temporary nature of the effect of the amphoteric compounds also requires that a more nearly permanent, inorganic non-amphoteric permeability regulator be incorporated separately into the diaphragm or be used in concert with the amphoteric material. Conventional dopant materials, e.g., clays and magnesium compounds, such as magnesium chloride, are inorganic, non-amphoteric materials that may be added to the anolyte during the start-up period so that when the pH of the catholyte liquor within or at the surface of the diaphragm increases to the neighborhood of 10, these materials (and precipitates formed from them) can take the place of the amphoteric compound as the material used to moderate the diaphragm's permeability.

Examples of conventional non-amphoteric materials that may be added to the anolyte compartment so as to continue to moderate the diaphragm's permeability after the amphoteric material dissolves and is removed with the catholyte liquor include, but are not limited to, compounds of magnesium, e.g., magnesium chloride-6 hydrate, magnesium hydroxide and magnesium hydrogen phosphate-3 hydrate; clays, such as amphibole clays, e.g., attapulgite and sepiolite clays, smectite clays, e.g., montmorillonite, saponite and hectorite clays, compounds of iron, such as iron chloride, and compounds of zirconium, e.g., zirconium oxychloride. The amount of these complementary dopant materials added to the anolyte will vary with the material used and the permeability of the diaphragm. Generally, they are used also in a permeability moderating amount. Attapulgite clay in amounts of from 20 to 200 grams per square meter of diaphragm surface and magnesium chloride-6-hydrate in amounts of from 2 to 40 grams as magnesium per square meter of diaphragm surface are the preferred non-amphoteric dopant additives It is preferred that the complementary doping compounds be added substantially at the same time as the amphoteric material with additional amounts added as needed near the end of the start-up period. In this embodiment, losses of some of the non-amphoteric material are to be expected initially, i.e., a portion will flow through the diaphragm and be carried out with the catholyte liquor. It is contemplated that the complementary dopant may be added subsequently to the addition of the amphoteric material(s) following start-up.

Prior to start-up, the anolyte compartment is filled with brine and a brine inventory accumulated in the cell system. In accordance with the present invention, a permeability moderating amount of amphoteric material(s) (and if desired complementary non-amphoteric dopant material(s)) are added to the anolyte and the cell energized. The conditions existing within the anolyte and catholyte compartments and within the diaphragm during the start-up period of a chlor-alkali diaphragm electrolytic cell are dynamic, i.e., in a state of flux. While not wishing to be bound by any particular theory, it is believed that the following occurs during the start-up period.

At start-up, brine is charged to the anolyte compartment at higher than steady-state flow rates to provide a level of brine in the anolyte that is sufficient to cover the diaphragm and hold it in place. Hydrous metal oxides or hydroxides of the amphoteric material(s) are captured and deposited within or on the surface of the diaphragm, thereby to close some pores of the diaphragm and lower its permeability. Immediately following start-up, chlorine is generated at the anode and a portion thereof hydrolyzes to form hydrochloric and/or hypochlorous acid, which dissolves in the anolyte, thereby resulting in an anolyte pH within the range of from 2 to 3.

In the catholyte compartment, hydroxyl ions are formed in the vicinity of the cathode and combine with alkali metal ions in the catholyte to form alkali metal hydroxide. The concentration of alkali metal hydroxide in the catholyte is low during the initial stages of the start-up period because the brine flowing through the diaphragm dilutes the alkali metal hydroxide formed in the catholyte. In addition, because substantial akalinity is present only in the immediate vicinity of the cathode, the magnesium ion, which may have been added earlier to the anolyte in the form of a magnesium compound is swept through the diaphragm into the catholyte by the rapidly moving percolating brine.

Lowering the permeability of the diaphragm by the precipitated forms of the added permeability moderating amount of amphoteric material(s) allows the flow rate of brine to the anolyte compartment to be decreased and results in an increase of the concentration of alkali metal hydroxide within the catholyte, and permits hydroxyl ions to diffuse into the diaphragm toward the anode. The pH within the catholyte rises with increasing concentration of alkali metal hydroxide and the catholyte permeates the diaphragm. As this occurs, precipitated forms, e.g., the hydrous oxides, of the amphoteric material are dissolved by the alkaline catholyte and are subsequently removed with the catholyte liquor discharged from the cell.

Complementary non-amphoteric dopant materials, such as magnesium chloride, form hydroxides at the higher pH levels now existing within the diaphragm and precipitate within the diaphragm to replace the amphoteric material, thereby replacing the function of the amphoteric precipitate materials which had previously served to adjust (lower) initially the permeability of the diaphragm during start-up.

Consequently, the amphoteric properties of the amphoteric compounds added to the anolyte prior to or at cell start-up beneficially affect the permeability of the diaphragm because the amphoteric compounds maintain an equilibrium between solubilization and precipitation over a wide range of pH conditions. The amphoteric materials contribute to reducing the permeability of the diaphragm at start-up but solubilize and migrate through the diaphragm and are eventually discharged from the cell with the catholyte liquor over time. Use of materials having the amphoteric characteristic as described herein gives heretofore unachievable results wherein a precipitate reliably controls diaphragm permeability at start-up but disappears after start-up when it is no longer required.

Synthetic diaphragms useful in chlor-alkali electrolytic cells are those prepared with non-asbestos fibrous materials or combination of fibrous materials as is known to those skilled in the chlor-alkali art. Such diaphragms may be prepared by art-recognized techniques. Typically, chlor-alkali diaphragms are prepared by vacuum depositing the diaphragm material from a liquid, e.g., aqueous, slurry onto a permeable substrate, e.g., a foraminous cathode. The foraminous cathode is electro-conductive and may be a perforated sheet, a perforated plate, metal mesh, expanded metal mesh, woven screen, an arrangement of metal rods, or the like having equivalent openings typically in the range of from about 0.05 inch (0.13 cm) to about 0.125 inch (0.32 cm) in diameter. The cathode is typically fabricated of iron, iron alloy or some other metal resistant to the operating chlor-alkali electrolytic cell environment to which it is exposed, for example, nickel. The diaphragm material is typically deposited directly onto the cathode substrate in amounts ranging from about 0.3 to about 0.6 pound per square foot (1.5 to 2.9 kilogram per square meter) of substrate, the deposited diaphragm typically having a thickness of from about 0.075 to about 0.25 inches (0.19 to 0.64 cm).

Synthetic diaphragms used in chlor-alkali electrolytic cells are prepared predominantly from organic fibrous polymers. Useful organic polymers include any polymer, copolymer, graft polymer or combination thereof which is substantially chemically and mechanically resistant to the operating conditions in which the diaphragm is employed, e.g., chemically resistant to degradation by exposure to electrolytic cell chemicals, such as sodium hydroxide, chlorine and hydrochloric acid. Such polymers are typically the halogen-containing polymers that include fluorine. Examples thereof include, but are not limited to, fluorine-containing or fluorine- and chlorine-containing polymers, such as polyvinyl fluoride, polyvinylidene fluoride, polytetrafluoroethylene (PTFE), polyperfluoro(ethylene-propylene), polytrifluoroethylene, polyfluoroalkoxyethylene (PFA polymer), polychlorotrifluoroethylene (PCTFE polymer) and the copolymer of chlorotrifluoroethylene and ethylene (CTFE polymer). PTFE is preferred.

An important property of the synthetic diaphragm is its ability to wick (wet) the aqueous alkali metal halide brine solution which percolates through the diaphragm. Perfluorinated ion-exchange materials having sulfonic or carboxylic acid functional groups are typically added to the diaphragm formulation used to prepare the diaphragm to provide the property of wettability.

The preferred ion-exchange material is a perfluorinated ion-exchange material that is prepared as an organic copolymer from the polymerization of a fluorovinyl ether monomer containing a functional group, i.e., an ion-exchange group or a functional group easily converted into an ion-exchange group, and a monomer chosen from the group of fluorovinyl compounds, such as vinyl fluoride, vinylidene fluoride, trifluoroethylene, tetrafluoroethylene, hexafluoroethylene, hexafluoropropylene, chlorotrifluoroethylene and perfluoro (alkylvinyl ether) with the alkyl being an alkyl group containing from 1 to 10 carbon atoms. A description of such ion-exchange materials can be found in U.S. Pat. No. 4,680,101 in column 5, line 36, through column 6, line 2, which disclosure is incorporated herein by reference.

An ion-exchange material with sulfonic acid functionality is particularly preferred. A perfluorosulfonic acid ion-exchange material (5 weight percent solution) is available from E. I. du Pont de Nemours and Company under the tradename NAFION resin. Other appropriate ion-exchange materials may be used to allow the diaphragm to be wet by the aqueous brine fed to the electrolytic cell, as for example, the ion-exchange material available from Asahi Glass Company, Ltd. under the tradename FLEMION.

In addition to the aforedescribed fibers and microfibrils of halogen-containing polymers and the perfluorinated ion-exchange materials, the formulation used to prepare the synthetic diaphragm may also include other additives, such as thickeners, surfactants, antifoaming agents, antimicrobial solutions and other polymers. In addition, materials such as fiberglass may also be incorporated into the diaphragm. An example of the components of a synthetic diaphragm material useful in a chlor-alkali electrolytic cell maybe found in Example 1 of U.S. Pat. No. 5,188,712, the disclosure of which is incorporated herein by reference.

The liquid-permeable synthetic diaphragms described herein are prepared commonly by depositing the diaphragm onto the cathode, e.g., a foraminous metal cathode, of the electrolytic cell from an aqueous slurry comprising the components of the diaphragm, whereby to form a diaphragm base mat. The amount of each of the components comprising the diaphragm may vary in accordance with variations known to those skilled in the art.

The diaphragm base mat may be deposited from a slurry of diaphragm components directly upon a liquid permeable solid substrate, for example, a foraminous cathode, by vacuum deposition, pressure deposition, combinations of such deposition techniques or other techniques known to those skilled in the art. The liquid permeable substrate, e.g., foraminous cathode, is immersed into the slurry which has been well agitated to insure a substantially uniform dispersion of the diaphragm components and the slurry drawn through the liquid permeable substrate, thereby to deposit the components of the diaphragm as a base mat onto the substrate.

A coating of inorganic particulate material may be applied to the exposed surface of the diaphragm mat, i.e., the surface facing the anode or anolyte chamber, in order to regulate the porosity of the diaphragm and aid in the adhesion of the diaphragm mat to the substrate. As is known, one surface of the diaphragm base mat is adjacent to the foraminous cathode structure and therefore, only the opposite surface of the diaphragm mat, i.e., the exposed surface, is available to be coated.

The coating is preferably applied by dipping the diaphragm into a slurry of the coating ingredients and drawing the slurry through the diaphragm under vacuum. This procedure deposits a coating of the desired inorganic particulate materials on the top of the diaphragm mat and/or within the diaphragm mat to a depth a short distance below the formerly exposed surface of the diaphragm mat.

The topcoated diaphragm base mat is then dried, preferably by heating it to temperatures below the sintering or melting point of any fibrous organic material component used to prepare the diaphragm. Drying may be performed by heating the diaphragm at temperatures in the range of from about 50° C. to about 225° C., more usually at temperatures of from about 90° C. to about 150° C. for from about 10 to about 20 hours in an air circulating oven.

The synthetic diaphragm is liquid permeable, thereby allowing an electrolyte, such as sodium chloride brine, subjected to a pressure gradient to pass through the diaphragm. It is also permeable to alkali metal ions, e.g., sodium ions. Typically, the pressure gradient in a diaphragm electrolytic cell is the result of a hydrostatic head on the anolyte side of the cell, i.e., the liquid level in the anolyte compartment will be on the order of from about 1 to about 25 inches (2.54–63.5 cm) higher than the liquid level of the catholyte. The specific flow rate of electrolyte through the diaphragm may vary with the type and use of the cell.

As discussed, a topcoat is applied to the diaphragm base mat to attempt to regulate the initial porosity of the diaphragm, assist in the adhesion of the mat to the substrate and improve the integrity of the mat. The specific components of the topcoat and the amounts thereof used to form the topcoat will vary and depend on the choice of those skilled in the art.

A more detailed explanation of synthetic diaphragms, the components comprising such diaphragms, and the method by which they are prepared may be found in the above-mentioned U.S. patents relating to synthetic diaphragms.

The present invention is more particularly described in the following examples which are intended as illustrative only since numerous modifications and variations therein will be apparent to those skilled in the art.

In the following examples, all reported percentages are weight percents, unless noted otherwise or unless indicated as otherwise from the context of their use. The efficiencies of the laboratory chlor-alkali electrolytic cells are "caustic efficiencies", which are calculated by comparing the amount of sodium hydroxide collected over a given time period with the theoretical amount of sodium hydroxide that would be generated applying Faraday's Law. The reported weight density of the diaphragm mat and the coatings (topcoat) deposited on such mat are based upon the dry weight per unit area of the mat and topcoat.

EXAMPLE 1

Into a 4 liter plastic beaker fitted with a laboratory Greerco mixer were charged 2700 milliliters (ml) of water, 3.55 grams of AVANEL N-925 (90%) nonionic surfactant and 3.2 g UCARCIDE-250 biocide. The mixer was started and 15.08 grams (g) CELLOSIZE ER-52M hydroxyethyl cellulose and 6.0 g of a 4 weight % aqueous sodium hydroxide solution added to the beaker. The mixer was operated at 50% power until the viscosity of the mixture increased to avoid throwing portions of the mixture out of the beaker. After 5 minutes of such mixing, the mixer power was adjusted to 70% power and 15.6 g of TEFLON Floc [¼ inch(") (0.64 centimeters) (cm) chopped×6.6 denier] polytetrafluoroethylene added to the beaker. After 5 minutes, 6.67 g chopped PPG DE fiberglass [6.5 micron×⅛" (0.32 cm)] and 3.95 g SHORT STUFF GA-844 polyethylene fiber were added to the mixture. Subsequently, after 4 minutes of mixing 452 g of an aqueous suspension of TEFLON 60 polytetrafluoroethylene (PTFE) microfibrils (10% PTFE), which was prepared in accordance with the procedure described in U.S. Pat. No. 5,030,403, was added. After 4 minutes more of mixing, 14.46 g of NAFION NR-005 solution (5%) perfluorosulfonic acid ion exchange material were added to the mixture. After 4 more minutes mixing time, the mixer was stopped and the slurry diluted with water to a final weight of 3600 g to give a total suspended solids content of 2.0 weight percent. The resulting slurry was aged for about 1 day and air-lanced for about 20 minutes before use to insure uniform distribution of the contents of the slurry.

Diaphragm mats were deposited onto two laboratory steel screen cathodes using the aforedescribed slurry by drawing the slurry under vacuum through the steel screen cathodes (about 3.5"×3.5" (8.9 cm×8.9 cm) in screen area) so that the fibers in the slurry filtered out on the screen, which was about ⅛" (0.32 cm) thick. The vacuum was gradually increased from 1 inch (3.4 kPA) of mercury as the thickness of the diaphragm mat increased to about 16 inches (54.2 kPa) of mercury over a 10–12 minute period. The vacuum was held at 16 inches (54.2 kPa) of mercury for an additional 19–20 minutes and then the cathode was lifted from the slurry to allow the diaphragm to drain with the vacuum continued at 16 inches (54.2 kPa) of mercury for 5 minutes.

The vacuum was then adjusted to 20 inches of mercury (67.7 kPa). After 25 additional minutes, during which the vacuum fell to 13 inches of mercury (44.0 kPa), the vacuum drainage was discontinued. About 740–750 ml of total filtrate was collected.

The diaphragms were topcoated while still damp by drawing a suspension containing 1.67 grams/liter (gpl) each of ATTAGEL 50 attapulgite clay powder, ZIRCOA A zirconia powder and magnesium hydroxide in an aqueous dispersing medium of sodium chloride brine (305 gpl sodium chloride) and 1 weight percent AVANEL® N-925 surfactant, a $C_{12}$–$C_{15}$ Pareth-9 chloride, under vacuum trough the diaphragm mat. The vacuum during topcoating was increased gradually and held at 16 inches (54.1 kPa) of mercury until 200 ml of filtrate had been collected. The cathode and diaphragm were lifted from the topcoating bath. After 4 additional minutes under vacuum, the total filtrate volume drawn through the cathode screen was 290 ml. The topcoated diaphragms were dried for one hour with applied vacuum falling from 14 to 15 inches of mercury (47.4–50.8 kPA) to about 1 inch (3.4 kPA) of mercury. The vacuum was discontinued while the diaphragms dried an additional 15.5 hours at 115°–116° C. The topcoat weight was estimated to be 0.013–0,015 lb/sq ft (0.06–0.07 kg/m$^2$). The total diaphragm weights after drying were 21.4 grams each.

The resulting diaphragms were placed in separate laboratory chlor-alkali electrolytic cell to measure their performance. The cells were operated with an electrode spacing of ⅛" (0.32 cm), a temperature of 194° F. (90° C.) by use of internal thermostatically controlled heaters and a current set at 9.0 amperes [144 amperes/sq ft (ASF)]. Prior to cell start-up, the brine feed rate was adjusted to 4 ml/minute and the anolyte compartment filled with sodium chloride brine (305 gpl). The cell heaters were turned on and the cathode compartment discharge lines were stoppered so that a brine inventory could accumulate in the system. Preweighed additives of magnesium chloride (equivalent to 0.025 g as magnesium ion) and 0.50 g ATTAGEL 50 clay dispersed in 50 ml of sodium chloride brine (305 gpl) were added to the anolyte compartments of both cells to regulate diaphragm permeability on a long term basis. Aluminum sulfate (0.2 grams as aluminum) was added as an aqueous 1 percent solution to the anolyte compartment of cell 1 to regulate immediately the diaphragm permeability on start-up. Cell level build-up was allowed to proceed to a level of about 12 inches above the catholyte discharge outlet. Power to the cell was supplied 47 minutes after the initial filling and the catholyte discharge lines unstoppered. Performance data of the cells from the time power was supplied to the cells are tabulated in Table 1.

TABLE 1

| Elapsed Minutes | Level Inches | Voltage | $O_2$ | NaOH % |
|---|---|---|---|---|
| | Cell 1 - Aluminum Added | | | |
| 0 | 11.9 | | | |
| 1 | 11.8 | | | |
| 2 | 11.6 | | | |
| 3 | 11.3 | | | |
| 4 | 11.2 | 3.22 | | |
| 5 | 11.0 | | | |
| 9 | 10.8 | | | |
| 19 | 10.9 | | | |
| 33 | 11.4 | 3.1 | | |
| 85 | 15.9 | 3.07 | | 6.73 |
| 137 | 17.8 | 3.06 | 0.88 | |

TABLE 1-continued

| Elapsed Minutes | Level Inches | Voltage | $O_2$ | NaOH % |
|---|---|---|---|---|
| 193 | 20.3 | 3.06 | | |
| | (See footnote numbers 1, 2, 3) | | | |
| Hours | | | | |
| 21 | 13.8 | 3.02 | | 10.66 |
| 22 | 13.6 | 3.02 | 4.2 | |
| | (See footnote number 4) | | | |
| | Cell 2 - No Aluminum Added | | | |
| 0 | 12.1 | | | |
| 1 | 10.5 | | | |
| 2 | 8.4 | | | |
| 3 | 5.4 | | | |
| 4 | 4.0 | 3.05 | | |
| 5 | 3.6 | | | |
| 9 | 3.6 | | | |
| 19 | 5.0 | | | |
| 33 | 6.4 | 2.99 | | |
| 85 | 9.6 | 2.97 | | 4.81 |
| 137 | 15.8 | | 0.77 | |
| 193 | 11.8 | 2.95 | | |
| | (See footnote numbers 1, 2, 3) | | | |
| Hours | | | | |
| 21 | 9.8 | 2.97 | 3.7 | 9.23 |
| 22 | 9.4 | 2.97 | | |
| | (See footnote number 4) | | | |

[1]At 193 minutes, the brine feed rates were reduced to about 2 ml per minute.
[2]Cell 2 was given an additional 0.025 grams of magnesium (as magnesium chloride) at 193 minutes.
[3]Cell 1 was given an additional 0.025 grams of magnesium (as magnesium chloride) at 300 minutes.
[4]After one day of operation, the cells appeared to be operating normally but below target performance levels. Therefore, each cell was treated by increasing the brine feed rate to about 3 ml per minute for 1.5 hours, adding about 0.25 grams of ATTAGEL 50 clay, acidifying the anolyte temporarily to pH 1.8 and reducing the feed rate back to 2 ml per minute after a total of four hours.

The level of the catholyte in cell 1 fell only about 1 inch from the level at start-up during the first 3 hours of operation; whereas it fell about 8½ inches in cell 2 during that period. The data of Table 1 show the benefit of adding an amphoteric material, such as an aluminum compound, to the anolyte of a chlor-alkali diaphragm cell on start-up. It should be further understood that the impact of starting up a commercial chlor-alkali cell in a manner similar to cell 2 can be disastrous. If, in a commercial cell, a level drop similar to that of cell 2 had occurred, extreme measures such as providing many times the normal brine feed rate, adding excessive amounts of other doping agents, or shutting down the cell entirely would have been necessary to avoid a potential hydrogen gas explosion. Apart from the obvious impracticalities of such safety measures, such measures could also have harmed the eventual performance of the cell.

EXAMPLE 2

A chlor-alkali monopolar electrolytic cell having approximately 210 square feet of cathode area with expanded titanium mesh, DSA®-coated, expandable anodes and steel woven wire cathodes was provided with a synthetic diaphragm of the type described in Example 1. A topcoat of a mixture of attapulgus clay, magnesium hydroxide and zirconium oxide similar to that of Example 1 was deposited on the diaphragm from a 17% sodium hydroxide solution. On final assembly, one eighth-inch spacer rods were placed between the anode and the diaphragm before allowing the anode to expand. Before start-up, the cell was filled with brine to provide an anode compartment brine level of about twenty-four inches above the top of the cathode. A slurry of 2 pounds of magnesium chloride hexahydrate, 6.7 pounds of aluminum chloride hexahydrate and 2 pounds of attapulgus clay in water was added to the anode compartment about one minute before energizing the cell. Samples of the catholyte liquor were taken at intervals and analyzed for magnesium, aluminum and sodium hydroxide, as shown in Table 2. Two analyses, corresponding to the soluble and insoluble or filterable fractions of aluminum and magnesium are given in Table 2.

TABLE 2

| | Concentration of Aluminum, Magnesium and Sodium Hydroxide in Catholyte During Start up | | | | |
|---|---|---|---|---|---|
| Time, min. | Soluble Al, gum | Insoluble Al, ppm | Soluble Mg, ppm | Insoluble Mg, ppm | NaOH, wt. % |
| 2 | 2 | 4 | <0.2 | 6.3 | 1.09 |
| 12 | 2 | 4.5 | <0.2 | 50 | 2.43 |
| 27 | 10 | 2.7 | <0.2 | 35 | 4.28 |
| 42 | 20 | 1.7 | <0.2 | 21 | 5.82 |
| 67 | 31 | 0.7 | <0.2 | 4.9 | 7.34 |
| 102 | 42 | 0.4 | <0.2 | 2.0 | 8.48 |
| 132 | 49 | 0.4 | <0.2 | 1.5 | 8.27 |
| 196 | 52 | 0.3 | <0.2 | 0.99 | 7.86 |
| 257 | 58 | 0.5 | <0.2 | 1.1 | 8.50 |
| 1309 | 4 | 0.1 | <0.2 | 0.62 | 9.84 |
| 2779 | 2 | <0.2 | <0.2 | 0.32 | 9.88 |

Referring to Table 2, the magnesium component of the catholyte is predominantly insoluble magnesium hydroxide, which may have precipitated after passing out of the diaphragm into the catholyte or, if already precipitated in the diaphragm, was of too small a size to have been caught in the interstices of the diaphragm. On the other hand, aluminum in the catholyte is nearly entirely in the dissolved, alkali-soluble aluminate ion form. The small amount of insoluble aluminum is probably in the form of attapulgite particles not caught in the diaphragm.

In addition to the data of Table 2, the total amounts of aluminum, magnesium and sodium hydroxide are plotted against time (minutes elapsed) after energizing the cell, in FIG. 1. As shown in FIG. 1, the magnesium concentration rises rapidly in the first ten minutes of operation as it is swept through the diaphragm by the fast flowing brine. Little aluminum is present in the catholyte at this time because it is being retained within the diaphragm as a precipitate, e.g., as an aluminum hydroxide. After 10 minutes and as a direct result of the permeability control imparted by the precipitated amphoteric aluminum compound, alkalinity within the diaphragm is established and the alkali metal hydroxide concentration in the catholyte rises. The magnesium concentration in the catholyte begins to fall over time as the concentration of aluminum increases. The practical effect of this observation is that magnesium hydroxide replaces aluminum hydroxide as the permeability controlling agent within the diaphragm, which is a desirable outcome inasmuch as magnesium hydroxide tends to be an important equilibrium constituent in the ongoing operation of a chlor-alkali diaphragm cell. The catholyte composition, being immediately downstream of the diaphragm, is indicative of the applicable upstream chemistry in the anolyte.

FIG. 1 also shows that the aluminum content and sodium hydroxide concentration in the catholyte are substantially parallel after about 200 minutes of operation, which suggests that aluminum will approach complete removal from the catholyte as the sodium hydroxide concentration approaches full strength.

Although the present invention has been described with reference to the specific details of particular embodiments thereof, it is not intended that such details be regarded as limitations upon the scope of the invention except as and to the extent that they are included in the accompanying claims.

What is claimed is:

1. In the process of operating a chlor-alkali electrolytic cell having a synthetic liquid permeable diaphragm separating the anolyte compartment from the catholyte compartment, the improvement which comprises introducing into the anolyte compartment during the cell start-up period a permeability moderating amount of inorganic amphoteric material that is soluble in the anolyte, that has an insoluble form under the conditions existing within the diaphragm, and that is dissolved by product catholyte liquor.

2. The process of claim 1 wherein the chlor-alkali cell electrolyzes sodium chloride brine and the product catholyte liquor is sodium hydroxide.

3. The process of claim 2 wherein the amphoteric material is selected from compounds of aluminum, zinc and mixtures of such compounds.

4. The process of claim 3 wherein the amphoteric compound is added at cell start-up.

5. The process of claim 3 wherein the product catholyte liquor has a concentration of from 9.5 to 11.5 weight percent sodium hydroxide.

6. The process of claim 3 wherein a permeability moderating amount of non-amphoteric inorganic material is added also to the anolyte during the cell start-up period.

7. The process of claim 6 wherein the non-amphoteric inorganic material is selected from magnesium compounds, zirconium compounds, amphibole clays, smectite clays and mixtures of such inorganic materials.

8. The process of claim 7 wherein the non-amphoteric inorganic material is magnesium chloride, magnesium chloride hydrates, clays selected from attapulgite, sepiolite, montmorillonite, saponite and hectorire clays, and mixtures of such inorganic materials.

9. The process of claim 6 wherein the non-amphoteric inorganic material is added to the anolyte contemporaneously with the amphoteric material.

10. In the process of operating a chlor-alkali electrolytic cell for the electrolysis of sodium chloride brine, said cell having a synthetic liquid permeable diaphragm separating the anolyte compartment from the catholyte compartment, the improvement which comprises introducing into the anolyte compartment during the cell start-up period a permeability moderating amount of an amphoteric aluminum compound selected from aluminum chloride, aluminum sulfate, aluminum nitrate, hydrates of said aluminum compounds and readily soluble forms of aluminum hydroxide.

11. The process of claim 10 wherein from 8 to 50 grams of the aluminum compound, calculated as elemental aluminum, per square meter of diaphragm surface area is used.

12. The process of claim 11 wherein from 15 to 35 grams of the aluminum compound are used.

13. The process of claim 10 wherein a permeability moderating amount of non-amphoteric inorganic material selected from magnesium compounds and clays are added also to the anolyte during the start-up period.

14. The process of claim 13 wherein the non-amphoteric inorganic material is selected from magnesium chloride, magnesium chloride hydrates, clays selected from attapulgite, sepiolite, montmorillonite, saponite and hectorire clays, and mixtures of such inorganic materials.

15. The process of claim 14 wherein from 15 to 35 grams of the aluminum compound, calculated as aluminum, per square meter of diaphragm surface; from 2 to 40 grams of the magnesium compound, calculated as magnesium, per square meter of diaphragm surface, and from 20 to 200 grams of clay per square meter of diaphragm surface, are added to the anolyte.

16. The process of claim 14 wherein the non-amphoteric inorganic material is added to the anolyte contemporaneously with the amphoteric material.

17. The process of claim 13 wherein the amphoteric material is aluminum chloride or hydrates of aluminum chloride; and the non-amphoteric material is magnesium chloride, hydrates of magnesium chloride, attapulgite clay and mixtures of said non-amphoteric materials.

18. The process of claim 17 wherein the amphoteric material is added at cell start-up.

* * * * *